US006412387B1

(12) United States Patent
French

(10) Patent No.: US 6,412,387 B1
(45) Date of Patent: Jul. 2, 2002

(54) DETONATOR MEMBER AND A METHOD OF ITS USE

(75) Inventor: John Robert French, Melton Mowbray (GB)

(73) Assignee: J R French Limited, Leicestershire (GB)

( * ) Notice: Subject to any disclaimer, the term of this patent is extended or adjusted under 35 U.S.C. 154(b) by 0 days.

(21) Appl. No.: 09/623,716

(22) PCT Filed: Mar. 5, 1999

(86) PCT No.: PCT/GB99/00651

§ 371 (c)(1),
(2), (4) Date: Apr. 13, 2001

(87) PCT Pub. No.: WO99/45335

PCT Pub. Date: Sep. 10, 1999

(30) Foreign Application Priority Data

Mar. 7, 1998 (GB) ..... 9804827

(51) Int. Cl.[7] ..... F41R 5/00
(52) U.S. Cl. ..... 89/1.13
(58) Field of Search ..... 89/1.13; 102/403

(56) References Cited

U.S. PATENT DOCUMENTS 1,841,802 A * 1/1932 Gettelman ..... 299/37.4
2,425,018 A * 8/1947 Williams ..... 299/37.4
2,460,322 A 2/1949 Walker
3,498,177 A * 3/1970 Moro ..... 89/1.13
5,198,608 A * 3/1993 Cahill et al. ..... 89/1.13
5,373,774 A * 12/1994 Akbar ..... 89/1.13
5,712,441 A * 1/1998 Grunewald ..... 89/1.13
5,936,185 A * 8/1999 Tokuni ..... 89/1.13
5,979,289 A * 11/1999 French ..... 89/1.13

FOREIGN PATENT DOCUMENTS

FR 994814 * 11/1951
FR 996084 * 12/1951
GB 2132567 * 7/1984
WO WO97/08508 3/1997

* cited by examiner

*Primary Examiner*—Charles T. Jordan
*Assistant Examiner*—Jordan Lofdahl
(74) *Attorney, Agent, or Firm*—Fish & Richardson P.C.

(57) ABSTRACT

In the field of landmine clearance there is a need for a detonator member that is effective in detonating mines whilst protecting any apparatus to which it is secured. The invention relates to a detonator member (10) comprising two inclined plates (12, 13) secured together along a common edge to define a fulcrum (14). The plates are pivotably suspended from a further, moveable member (22) so that the axis of pivoting lies forward of the fulcrum (14). On downward movement of the further member (22) the fulcrum engages the ground (23) and causes the plates to pivot so that one of them (12) lies flat on the ground (23). This plate (12) detonates any landmines under it. During the detonation the plate (12) flips upwardly to a substantially vertical, blast-deflecting position. The other plate (13) limits the travel of blast deflecting plate (12), by virtue of contact with the ground (23).

17 Claims, 3 Drawing Sheets

DETONATOR MEMBER AND A METHOD OF ITS USE

This invention relates to a detonator member and to a method of its use.

Herein the term "detonator member" means a member for detonating explosive devices, especially those on, embedded in or obscured by a surface. Principal among these are landmines, comprising a rigid casing containing an explosive compound and a pressure-sensitive detonator mechanism. As is well known, such mines are usually buried a very short distance below the surface of the ground so as to obscure the landmines. Pressure from a vehicle wheel or a pedestrian's foot is generally sufficient to operate such a landmine and cause it to explode.

There are other types of mines that are detonated by means of eg. magnetic switches (that are activated by eg. the passage of a vehicle); or tripwires.

There are also some types of explosives devices that lack the explosive compound and instead rely on mechanical energy storage devices to provide an explosive release of energy on detonation.

Although landmines are primarily laid on or buried in the ground they are also sometimes concealed in eg. the walls, ceilings and roofs of buildings; and on bridges.

There is great concern about the use in many places of so-called "anti-personnel" landmines. These are comparatively small landmines specifically designed to injure or kill pedestrians. Anti-personnel landmines are cheap and hence are sometimes placed in eg. fields in their hundreds and even thousands by armies. Since the anti-personnel mines usually have few or no metal components they are difficult to detect using electromagnetic mine-detecting apparatuses. Thus they may remain a permanent hazard to civilian populations.

There is work, mostly undertaken by civilian organizations, in several countries to remove anti-personnel mines following termination of military action. Much of such work necessarily involves simply detonating the landmines, which is a hazardous task.

Patent application Ser. No. WO97/08508 discloses an apparatus for detonating landmines and similar devices. The apparatus comprises an hydraulic ram having a substantially planar foot secured at one end thereof. The ram is reciprocable in a substantially vertical direction (towards and away from the ground) and horizontally (ie. generally parallel to the ground) when the foot is raised above the ground. At its top end the ram includes an hydraulic circuit that acts as a damper (shock absorber) when the foot experiences an impulse following detonation of a landmine beneath it. The apparatus of WO97/08508 is operated by advancing the ram, and hence the foot, towards the ground in an attempt to detonate a landmine. If no detonation occurs the ram is raised and the foot moved horizontally a short distance before the ram is reversed to bring the foot into contact with the ground in a further attempt to detonate a landmine.

The apparatus of WO97/08508 represents a significant improvement in the safety of landmine clearance. Surprisingly, however, the inventor has devised improvements to the apparatus of WO97/08508.

According to a first aspect of the invention, there is provided a detonator member for an explosive device on, embedded in or obscured by a surface, the detonator member comprising first and second faces secured relative to one another to define a fulcrum;

a moveable support for moving the detonator member towards and away from the surface; and a pivot interconnecting the support and the first and second surfaces, the pivot and the fulcrum being spaced from one another in a direction normal to the direction of movement of the detonator member so that after the fulcrum contacts the surface, further movement of the member towards the surface causes detonator member to pivot about the fulcrum to cause the first face to abut the surface.

If the fulcrum of this member detonates a landmine, the first and second surfaces advantageously shield the pivot and support against the resulting impulse. If such detonation fails to happen, further movement of the support towards the surface flattens the first face onto the surface so that it may potentially detonate a landmine. Thus the reliability of detonation is good.

The invention is successful in detonating all types of mine as mentioned herein.

Preferably on the first face detonating a said explosive device, the detonator member swivels about the fulcrum and/or the pivot so that the first face lies substantially parallel to the direction in which the energy released by the explosive device predominantly acts.

It is more likely that the first surface (as opposed to the fulcrum) will detonate a landmine in use of the detonator member. The ability of the first surface to swivel to a blast deflecting position generally parallel to the direction in which the explosion force generally acts significantly reduces the risk of damage to the landmine detonating apparatus, including the detonator member. Thus the reusability of the detonator member is significantly improved.

Conveniently as a result of the swivelling, the second face abuts the surface to limit movement of the first surface.

This advantageously ensures that the first surface adopts a blast deflecting position immediately after it has detonated a landmine.

Further, advantageous features of the detonator member of the invention are set out in dependent claims 4 to 13.

According to a second aspect of the invention, there is provided a method of detonating an explosive device on, embedded in or obscured by a surface, the method comprising:

i) moving the support of a member, and hence the member, according to any of claims 1 to 10 towards the surface;

ii) initially contacting the surface with the fulcrum; and iii) if said initial contacting fails to detonate a said device, further moving the support towards the surface so that the first face abuts the surface.

Optional steps of the method include:

iv) moving the support and hence the detonator member away from the surface;

v) moving the support and hence the detonator member laterally for contacting a new position on the surface; and vi) repeating steps (i) to (iii) as necessary.

This method advantageously utilises the motion of the detonator member defined herein.

There now follows a description of a preferred embodiment of the invention, by way of example, with reference being made to the accompanying drawings in which.

Figure 1:
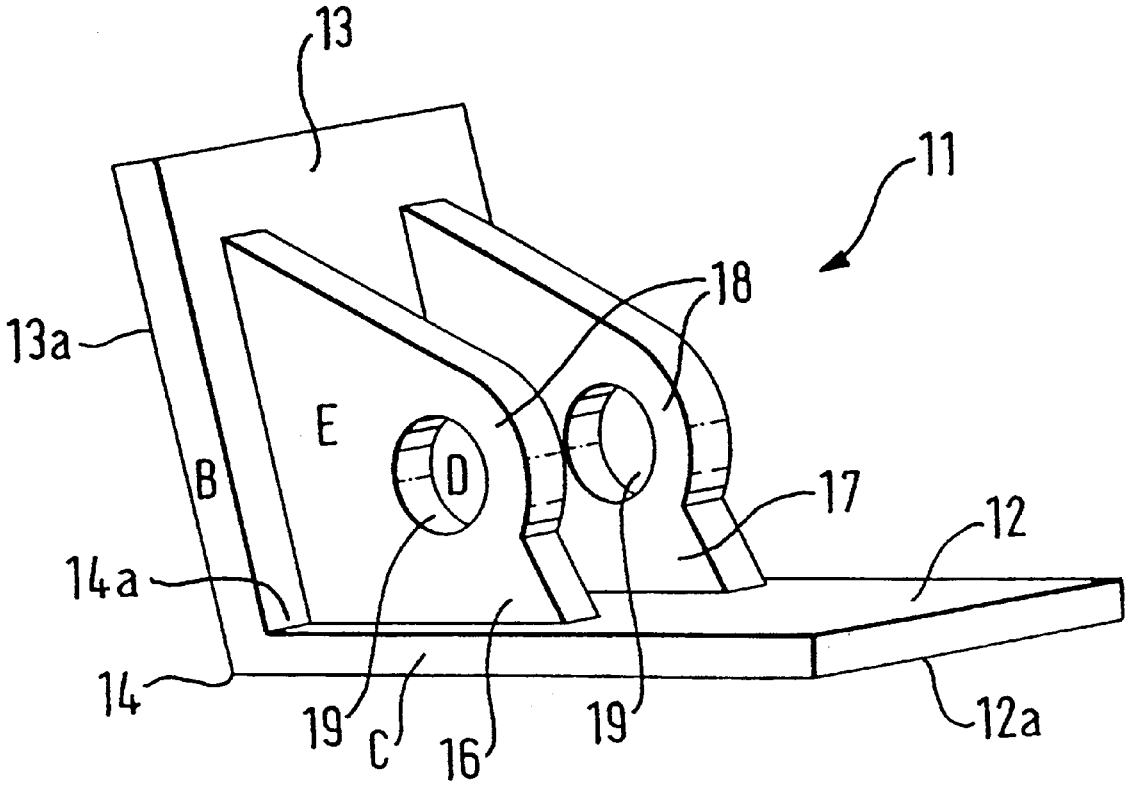
FIG. 1 is a perspective view of the main sub-assembly of a detonator member according to the invention.

Referring to the drawings there is shown a detonator member 10 according to the invention. Detonator member 10 comprises a main subassembly 11 (FIG. 1). Sub-assembly 11 includes a pair of rectangular plates 12, 13 made from eg. a high strength steel. The plates 12, 13 are secured together along adjacent, minor edges to define a linear fulcrum 14 and respective first and second, outwardly directed flat faces 12*a* and 13*a*. The plates 12, 13 preferably are secured by welding along a line 14*a* on the interior of the sub-assembly corresponding to the position of the linear fulcrum 14. Other means of securing the plates (eg. adhesives) are also possible. An alternative arrangement is one in which a single plate is bent from a flat configuration to define the plates 12, 13 and fulcrum 14.

On the interior of sub-assembly 11 (ie. remote from the first and second faces 12*a*, 13*a*) the plates 12, 13 are rigidly interconnected by (in the embodiment shown) a pair 16, 17 of fillets secured to the respective plates 12, 13 eg. by welding.

The fillets 16, 17 are spaced from one another in the width-wise direction of the plates. Each fillet 16, 17 is of a substantially triangular shape, and includes a protuberance 18 supporting a through-going bore 19. The two bores 19 are concentric and each of the same diameter.

Each bore 19 is formed with its centre closer to first plate 12 than to second plate 13. Thus more of the mass of each fillet 16, 17 overlies second plate 13 than first plate 12.

Figure 2:
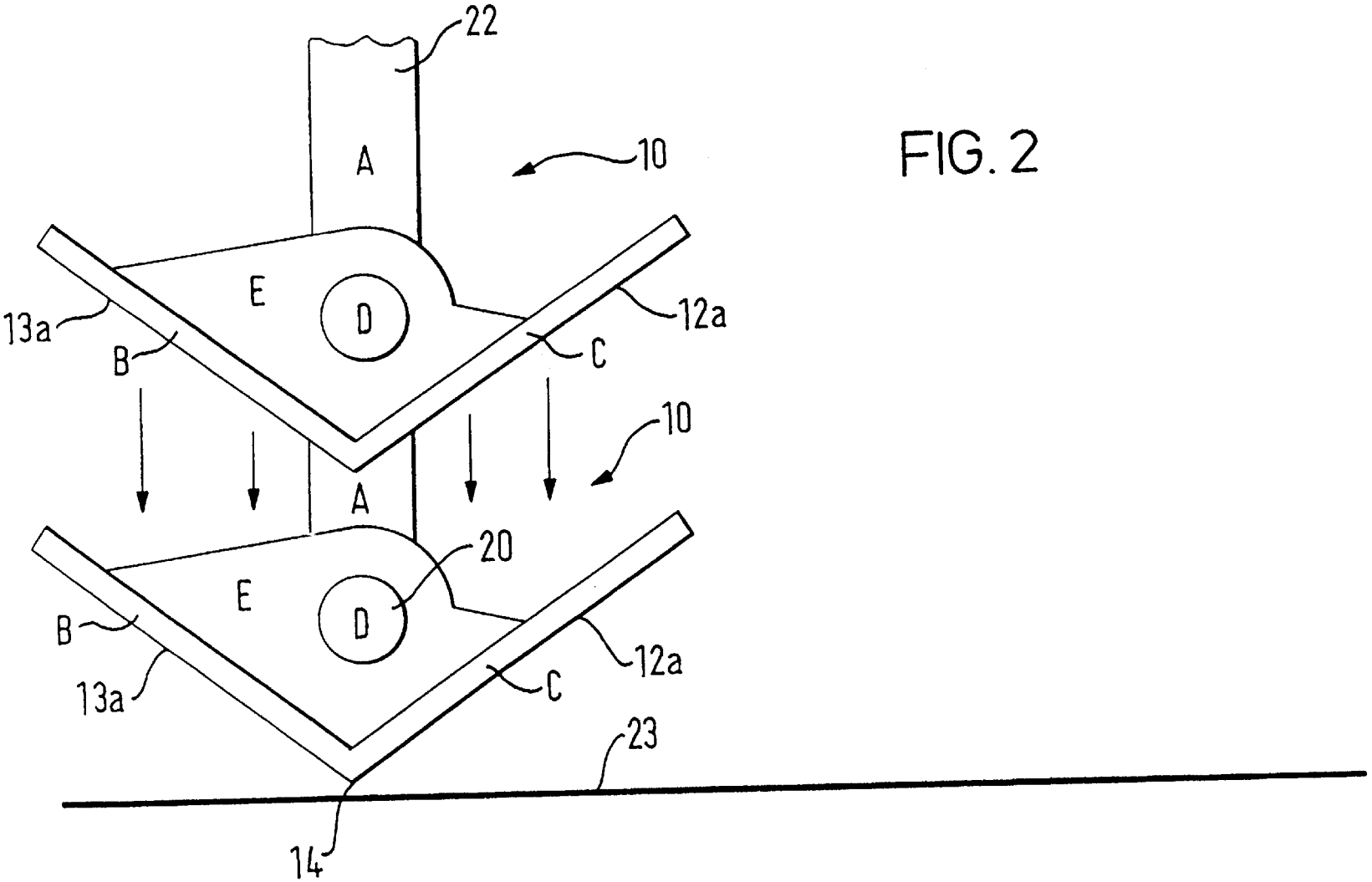
FIG. 2 shows the placing of the detonator member of the invention onto a surface eg. the ground.
Figure 4:
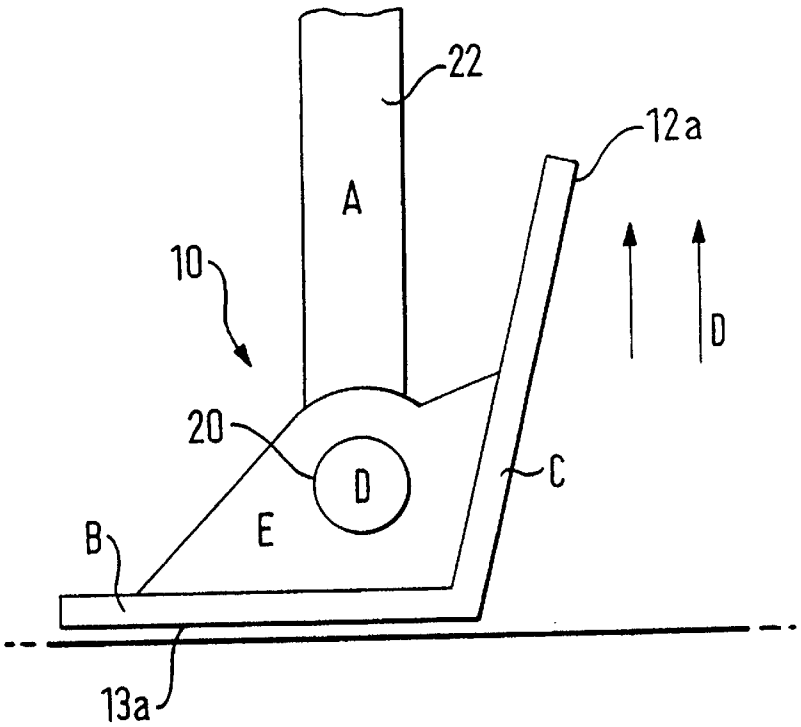
FIGS. 3 and 4 show a typical landmine detonation using the detonator member of the invention.
Figure 3:
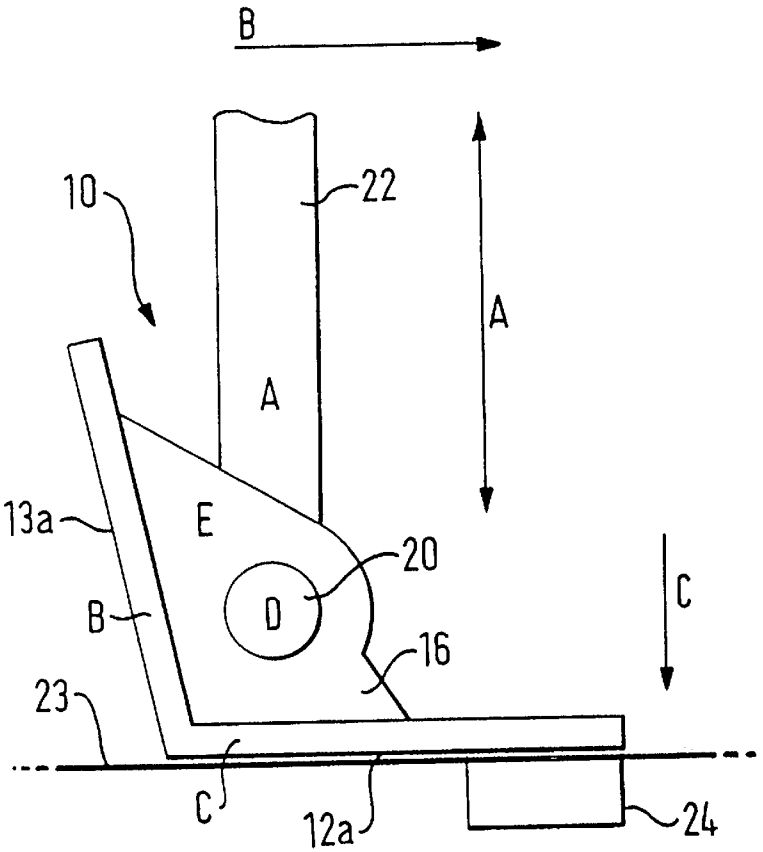

As is shown in FIGS. 2 to 4, the detonator member 10 includes a support in the form of cylindrical shaft 20 journalled at either end in a respective one of the apertures 19. The diameter of shaft 20 is such that it is a rotating fit in each aperture 19, thereby permitting pivoting of sub-assembly 11 relative to shaft 20. Shaft 20 may be retained in the longitudinal direction relative to the apertures 19, by conventional devices such as sprung washers or circlips.

At approximately its mid point, shaft 20 has rigidly secured thereto an upwardly extending member 22. Member 22 preferably is the cylindrical, free end of the output shaft of an hydraulic ram of the kind disclosed in WO97/08508. Thus the member 22, and hence the detonator member 10, may be reciprocated up and down relative to the ground 23 as indicated by arrows A. When member 22 is secured to the ram of an apparatus as described in WO97/08508, the assembly incorporating the ram is also capable of lateral movement (ie. movement substantially parallel to the ground 23) as indicated by arrow B. A similar effect of lateral movement may equally well be achieved by advancing a vehicle to which the ram mentioned hereinabove is attached.

In a further embodiment the connection between shaft 20 and member 22 is pivotable about an horizontal axis perpendicular to the longitudinal axis of shaft 20. This allows the member 10 to be placed flat on eg. inclined or undulating ground. Typically the maximum angular rotation of member 10 needed to achieve this is about 15° to either side of the horizontal. If desired, the pivoting may be limited to such an amount by is means of eg. stops welded or otherwise secured on the member 10 or shaft 22. Such stops ensure that the detonator member functions as described below even when the aforesaid further, pivotable connection is present. In use the detonator member 10 is initially raised to or held in the upper position shown in FIG. 2, by means of raising of the ram (or an equivalent device to which the member 22 is attached). This causes the detonator member 10 to pivot (by virtue of rotation of the fillets 16, 17 about shaft 20) to the position shown. Although in the embodiment shown plate 12 is longer than plate 13, the angles relative to the horizontal made by the respective plates 12, 13 are substantially equal because of the counterbalancing effect of the extra mass of the fillets 16, 17 overlying plate 13 as compared with plate 12.

The detonator member 10 is then lowered, as shown schematically in FIG. 2, by virtue of lowering of member 22, until the fulcrum 14 contacts the ground 23.

If the fulcrum chances to detonate a landmine at this point, the blast therefrom is deflected to either side of fulcrum 14. The substantially shallow equiangular orientation of the plates 12, 13 tends to cause the energy from the landmine explosion to travel horizontally, away from: the pivot (19, 20); the remainder of the landmine clearing apparatus above member 22; and any people nearby.

Detonations by the fulcrum 14 however are rare, because of its almost infinitesimal surface area compared with plate 12.

If member 22 continues to descend further than shown in the lower view in FIG. 2, the forward spacing of the centre of shaft 20 relative to fulcrum 14 causes sub-assembly 11 to tilt or swivel forwardly so that face 12*a* of plate 12 lies flat on (ie. parallel to) the ground 23, as shown in FIG. 3.

If as a result of this motion face 12*a* contacts and detonates a landmine 24 (obscured by the surface of the ground in FIG. 3), the impulse from the resulting explosion acts on face 12*a* forwardly of the centre of shaft 20. This drives face 12*a* upwardly so that sub-assembly 11 pivots about shaft anticlockwise in the view of FIGS. 2 to 4. This in turn causes face 13*a* to lie flat on the surface of the ground 23, thereby limiting the rotation of sub-assembly 11, as shown in FIG. 4.

With face 12*a* positioned as shown in FIG. 4 the impulse from the landmine explosion acts predominantly upwardly and (by virtue of its slight inclination to the vertical) forwardly of face 12*a*. The angle of the plates 12, 13 relative to one another are chosen to achieve this position when face 13*a* is flat on the ground 23. As a result plate 12 protects the pivot defined by the bores 19 and shaft 20 from damage by the landmine. Assuming that shaft 20 is attached to a device including a damper, any minor upward forces transmitted via the detonator member are easily absorbed.

If the face 12*a* fails to contact a landmine 24 when it lies flat on the ground 23, the member 22 may be reciprocated upwardly and subsequently moved laterally in the direction of arrow B. The process of lowering the detonator member 10 is then repeated in order to detonate any mines beneath its new position. When connected to the apparatus of WO97/08508, the detonator member may be advanced in the direction of arrow by half the "footprint" of the detonator member 10 at a time, thereby ensuring that all ground in front of the detonator member 10 is tested and any mines therein detonated. For this purpose the plates 12, 13 preferably are at least as wide as any vehicle carrying the detonator member.

In an alternative embodiment a vehicle may support a plurality of the members 22 (either respectively connected to discrete hydraulic rams or connected to a common ram) and a corresponding plurality of the plates 12, 13 in an abutting linear array. this achieves the benefit of a substantially continuous member the same width of the vehicle while allowing individual portions of the member to deflect on detonating a landmine. Also, when the individual portions are pivotable in a second direction as described herein the detonator member may readily accommodate ground undulations of a smaller dimension than the entire width of the vehicle.

What is claimed is:

1. A detonator member for an explosive device on, embedded in or obscured by a surface, the detonator member comprising first and second faces secured relative to one another to define a fulcrum;

a moveable support for moving the detonator member towards and away from the surface; and a pivot interconnecting the support and the first and second surfaces, the pivot and the fulcrum being spaced from one another in a direction normal to the direction of movement of the detonator member so that after the fulcrum contacts the surface, further movement of the member towards the surface causes detonator member to pivot about the fulcrum to cause the first face to abut the surface.

2. A detonator member according to claim 1 wherein, on the first face detonating a said explosive device, the detonator member swivels about the fulcrum and/or the pivot so that the first face lies substantially parallel to the direction in which the energy released by the explosive device predominantly acts.

3. A detonator member according to claim 2 wherein as a result of such swivelling the second face abuts the surface, to limit movement of the first surface.

4. A detonator member according to claim 1 wherein the first and second faces define a shield that isolates the support and the pivot from the energy released by the explosive device.

5. A detonator member according to claim 1 wherein the first and second faces are suspended from the support buy means of the pivot.

6. A detonator member according to claim 1 wherein the first and second faces constitute a sub-assembly that is biased to a pivot shielding position when out of contact with the surface.

7. A detonator member according to claim 6 including one or more weights for biasing the sub-assembly.

8. A detonator member according to claim 6 or claim 7 wherein in the pivot shielding position the first and second faces lie at complementary angles to the surface.

9. A detonator member according to claim 8 wherein the respective complementary angles are substantially equal.

10. A detonator member according to claim 1 wherein the support is moveable laterally in a direction generally parallel to the surface.

11. A detonator member according to claim 10 wherein the pivot lies forward of the fulcrum in the direction of lateral movement of the support.

12. A detonator member according to claim 1 wherein the support is connected to a shock absorber.

13. A detonator member according to claim 1 wherein the support is connected to a ram capable of applying via the detonator member a constant pressure regardless of the vertical location, within its permitted vertical travel, of the detonator member.

14. A detonator member according to claim 1 including a pivotable mounting whereby the detonator member is pivotable about a further axis perpendicular to the axis of said pivoting about the fulcrum.

15. A detonator member according to claim 14 including one or more limit members for limiting pivoting about the further axis.

16. A method of detonating an explosive device on, embedded in or obscured by a surface, the method comprising:

i) moving the support of a detonator member, and hence the member according to claim 1 towards the surface;

ii) initially contacting the surface with the fulcrum; and iii) if said initial contacting fails to detonate a said device, further moving the support towards the surface so that the first face abuts the surface.

17. A method according to claim 16 wherein, if step (iii) fails to detonate a said explosive device, the method includes the further step of:

iv) moving the support and hence the detonator member away from the surface;

v) moving the support and hence the detonator member laterally for contacting a new position on the surface; and vi) repeating steps (i) to (iii) as necessary.

* * * * *

UNITED STATES PATENT AND TRADEMARK OFFICE

CERTIFICATE OF CORRECTION

PATENT NO. : 6,412,387 B1
DATED : July 2, 2002
INVENTOR(S) : John Robert French

It is certified that error appears in the above-identified patent and that said Letters Patent is hereby corrected as shown below:

Column 2,
Line 55, replace “utilises” with -- utilizes --.

Column 4,
Line 55, replace “this” with -- This --.

Column 5,
Line 4, replace “surfaces” with -- faces --.
Line 19, replace “surfaces” with -- face --.
Line 25, replace “buy” with -- by --.

Signed and Sealed this

Twenty-sixth Day of November, 2002

*Attest:*

*Attesting Officer*

JAMES E. ROGAN
*Director of the United States Patent and Trademark Office*